United States Patent [19]

Buchs et al.

[11] 4,382,712

[45] May 10, 1983

[54] LOAD TRANSMITTING CONNECTING ELEMENT WITH BOLT EYES

[75] Inventors: Wolfgang Buchs, Valley; Rolf Staedtler, Rosenheim, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 287,479

[22] Filed: Jul. 27, 1981

[30] Foreign Application Priority Data

Aug. 28, 1980 [DE] Fed. Rep. of Germany ..... 3032443

[51] Int. Cl.[3] ..... B25G 3/00; F16D 1/00; F16G 11/00

[52] U.S. Cl. ..... 403/405; 244/131; 52/726; 52/309.13

[58] Field of Search ..... 244/123, 124, 131; 52/84, 574, 726, 309.13; 403/376, 339, 340, 364, 375, 405, 406

[56] References Cited

U.S. PATENT DOCUMENTS

| | | | |
|---|---|---|---|
| 1,338,836 | 5/1920 | Mix | 52/84 |
| 1,941,348 | 12/1933 | Hathorn | 244/131 X |
| 3,476,484 | 11/1969 | Brunsch | 416/230 A |
| 3,901,223 | 8/1975 | May | 403/161 |
| 3,950,115 | 4/1976 | Euler | 244/123 X |
| 4,113,910 | 9/1978 | Loyd | 244/131 X |
| 4,200,946 | 5/1980 | Lawrence | 244/123 X |
| 4,275,122 | 6/1981 | Fisher | 52/726 X |

FOREIGN PATENT DOCUMENTS

| | | | |
|---|---|---|---|
| 2645174 | 10/1976 | Fed. Rep. of Germany | 416/230 A |
| 3032443 | 3/1982 | Fed. Rep. of Germany | 52/665 |

*Primary Examiner*—Wayne L. Shedd

*Attorney, Agent, or Firm*—W. G. Fasse; D. H. Kane, Jr.

[57] ABSTRACT

A force or load transmitting connecting element is provided at its ends with bolt eyes for receiving bolts which secure the connecting element to another structural component also provided with complementary bolt eyes or for securing a wing to an aircraft body. The bolt eyes must be capable of taking up compression and/or tension loads. For this purpose at least one reinforcing bridging web is located between at least two bolt eyes. The bridging web extends with its main plane perpendicularly to the central axes of the bolt eyes and loops at least partially around at least one of the bolt eyes. The bolt eyes are constructed as metal bushings. Thus, the bridging web braces the bolt eyes relative to each other.

12 Claims, 12 Drawing Figures

LOAD TRANSMITTING CONNECTING ELEMENT WITH BOLT EYES

CROSS-REFERENCE TO RELATED APPLICATION

The present application corresponds to German Patent Application No. P 3,032,443.7, filed in the Federal Republic of Germany on Aug. 28, 1980. The priority of said German Patent Application is hereby claimed.

BACKGROUND OF THE INVENTION

The invention relates to a load transmitting connecting element with bolt eyes having at least two bolt eyes which are displaced relative to each other for connection to another structural component also provided with bolt eyes which are aligned with the bolt eyes of the connecting elements so that a bolt may extend through each group of aligned bolt eyes for the load transmission such as compression and/or tension forces. Such connecting elements may, for example, be used to secure a wing to the fuselage.

It has been found to be difficult to make sure that such connecting elements retain their shape and hence their stiffness for the purpose of load transmission if their bolt eyes extend outside the structural components to be connected with each other. This problem in the retention of the desired stiffness of the connecting elements is even more difficult to avoid where the structural components to be interconnected are relatively flat and the bolt eyes must, for structural reasons, extend at an angle relative to the plane defined by the structural components. In such situations there is the danger that the bolt eyes are pressed aside or are buckling as a result of the compression or tension loads.

OBJECTS OF THE INVENTION

In view of the above it is the aim of the invention to achieve the following objects singly or in combination:

- to reinforce connecting elements of the described type in such a manner that a lateral pressing aside or buckling of the bolt eyes is prevented;
- to construct these bolt eyes in such a manner that the use of fiber reinforced synthetic materials is especially feasible for their manufacture; and
- to brace the bolt eyes relative to each other.

SUMMARY OF THE INVENTION

According to the invention the above objectives have been achieved by locating at least one bridging web between at least two bolt eyes which take up compression and/or tension loads, whereby the plane defined by the bridging web extends perpendicularly to the axes of the bolt eyes so that the bridging web braces the bolt eyes relative to each other. Further, the bridging web loops at least around one bolt eye substantially or approximately in a semi-circular fashion. This basic structural application of a bracing web is feasible for use in connection with different types of bolt eye arrangements.

It is an advantage of the invention that the bridging webs greatly improve the stiffness and buckling strength of the connecting elements due to the semi-circular looping around the bolt eyes and due to their form-locking adaptation or merging into the chords of the connecting elements which transmit the forces or loads through the connecting elements.

Further, this stiffening effect makes it now possible to provide a connection between structural components which must be arranged at an angle relative to each other while still retaining the buckling strength or form stiffness therebetween to thereby avoid a lateral yielding or buckling.

BRIEF FIGURE DESCRIPTION

In order that the invention may be clearly understood, it will now be described, by way of example, with reference to the accompanying drawings, wherein:

FIG. 8 is a top plan view and FIG. 9 is a side view;

DESCRIPTION OF THE PRIOR ART

Figure 1:
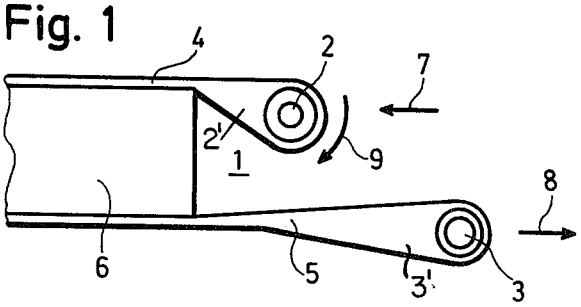
PRIOR ART Fig. 1
FIGS. 1 and 2 show a prior art connecting element in its top plan view and side view respectively.
Figure 2:
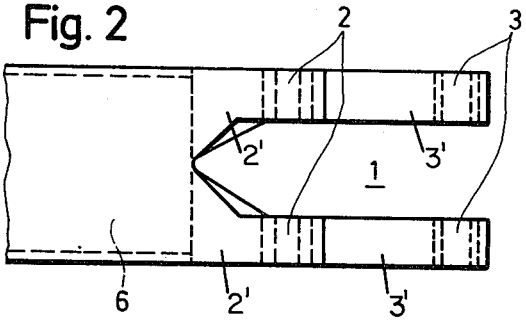
PRIOR ART Fig. 2

FIGS. 1 and 2 show a connecting element 1 according to the prior art which is not provided with any stiffening means between its bolt eyes 2 and 3. The bolt eyes 2 are located at the outer free end of respective shorter arms 2'. The bolt eyes 3 are located at the outer free end of respective longer arms 3'. Thus, the bolt eyes 2 and 3 are displaced relative to each other. However, the central axes of both bolt eyes 3 coincide and so do the central axes of both bolt eyes 2. The bolt eyes 2 are secured to a girder or strut 6 by means of an upper chord 4 which loops around the bolt eyes to form the arm 2' which extends inwardly or downwardly relative to a horizontal line running through the center of gravity of the chord 4 in FIG. 1. The bolt eyes 3 are also secured to the girder or strut 6 by a chord 5 which holds the bolt eyes 3 in a position almost on a horizontal line extending through the center of gravity of the chord 5. The chords 4 and 5 are bound into the girder or strut 6. If the bolt eyes 2 take up a compression load indicated by the arrow 7 while the bolt eyes 3 are exposed to a tension load as indicated by the arrow 8, there is the danger that the bolt eyes 2 will yield in the direction indicated by the arrow 9 whereby the entire connecting element 1 may be deformed. The invention aims at avoiding this problem.

DETAILED DESCRIPTION OF PREFERRED EXAMPLE EMBODIMENTS AND OF THE BEST MODE OF THE INVENTION

Figure 3:
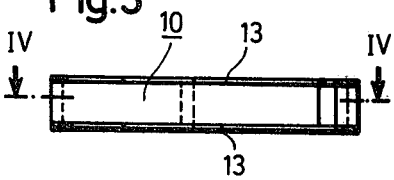
FIG. 3 shows a side view of a bridging web according to the invention suitable for use in combination with a prior art connecting element as shown in FIGS. 1 and 2.
Figure 4:
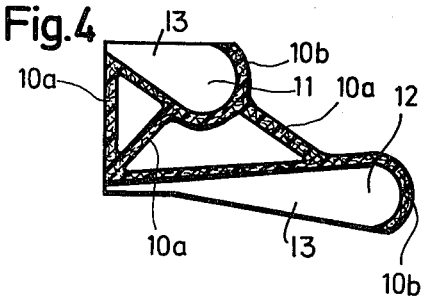
FIG. 4 is a sectional view along section line IV—IV in FIG. 3.

FIGS. 3 and 4 illustrate a bridging web member 10 according to the invention. Two of such bridging web members may be employed in a connecting element 1 such as shown in FIGS. 1 and 2. The bridging element forms two loops 11 and 12 which are braced against each other by support struts or ribs 10*a* and which each have a looping member 10*b*. Laterally applied cover members 13 further increase the stiffening effect. The looping members 10*b* are so dimensioned that the respective loops 11 and 12 reach around the corresponding bolt eyes 2 and 3 approximately in a semi-circular manner. By bracing each bridging member 10 with the stiffening ribs 10*a*, it is unnecessary to construct these members 10 as solid components and therefore a light structure results. The stiffening ribs 10*a* also brace the bridging member 10 relative to the strut or girder 6.

Preferably the stiffening ribs 10*a* and the looping members 10*b* forming the loops 11 and 12 are made of belts constructed of long fibers impregnated by synthetic resin. The covers 13 may, for example, be made of cross-wise windings constructed as a wound skin of fiber reinforced synthetic material. The cross-wise windings have the advantage of being better able to take up the support forces which are introduced into the covers by the stiffening ribs 10*a* and by the loop members 10*b*. The bridging member itself is preferably or suitably made of laminated fiber reinforced synthetic material.

Figure 5:
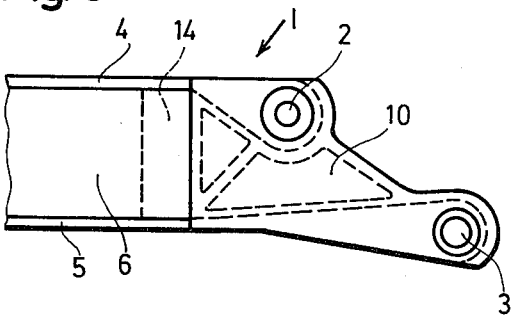
FIGS. 5 and 6 are views similar to FIGS. 1 and 2 respectively, however, with the bracing or bridging web according to the invention installed in such connecting element.
Figure 6:
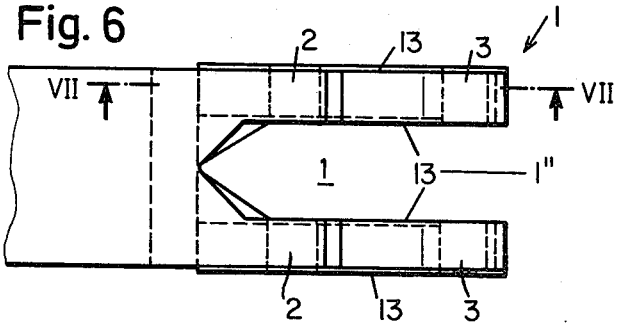
Figure 7:
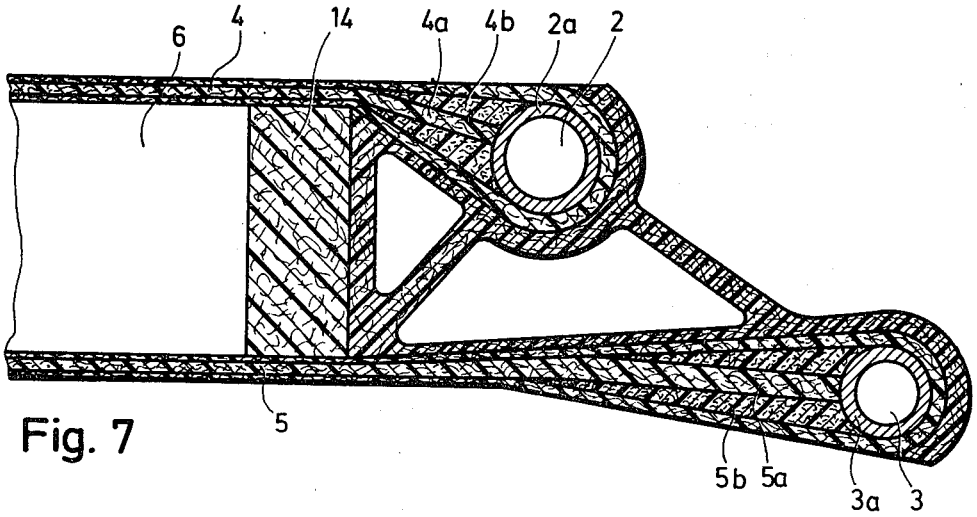
FIG. 7 is a sectional view along section line VII—VII in FIG. 6.

FIGS. 5, 6, and 7 illustrate a connecting element 1' of the type also illustrated in FIGS. 1 and 2, however, improved by a bridging element 10 as shown in FIGS. 3 and 4. According to the invention the connecting element is stiffened or reinforced between the legs 2' and 3' in one plane and between the respective legs in the second lower plane while the space 1'' remains free, see FIG. 6. The sectional view of FIG. 7 shows that the chords 4 and 5 are constructed as loops or bights which reach entirely around the respective bolt eye 2 and 3 respectively. The chords 4 and 5 are manufactured of fiber reinforced synthetic material, whereby a reinforcing central chord 4*a* and 5*a* is so located as to brace the respective metal bushing 2*a* and 3*a* forming the bolt eyes against compression loads. The wedge shaped spaces between the outer chord legs of the chord 4 and the central or inner chord 4*a* are filled by filler members 4*b*. Similarly, the wedge shaped spaces between the legs of the outer chord 5 and the central chord member 5*a* are filled with filler members 5*b*. The filler members 4*b* and 5*b* are, for example, manufactured of short fibers embedded in synthetic resin. Reinforcing elements 14 also made of fiber reinforced synthetic material are provided preferably on both sides of the girder or spar 6 for improving the introduction of the forces or loads from the bolt eyes into the girder or spar 6. The bridging members 10, the bolt eyes 2 and 3, the covers 13, and the chords 4, 4*a*, 5, 5*a* and the metal bushings 2*a*, 3*a*, are all intimately bonded to one another by a suitable adhesive. Such adhesives are well known in the art of fiber reinforced construction. For example, the embedding or impregnating resin upon curing may itself form a suitable bonding adhesive.

Figure 8:
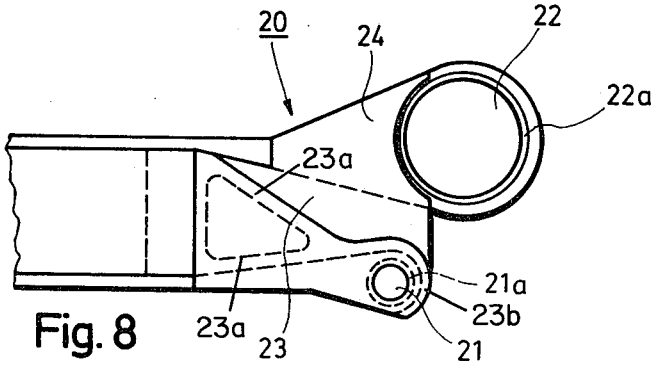
FIGS. 8 and 9 show a further example embodiment of a connecting element according to the invention having three bolt eyes and using two reinforcing or bracing bridging web members, whereby
Figure 9:
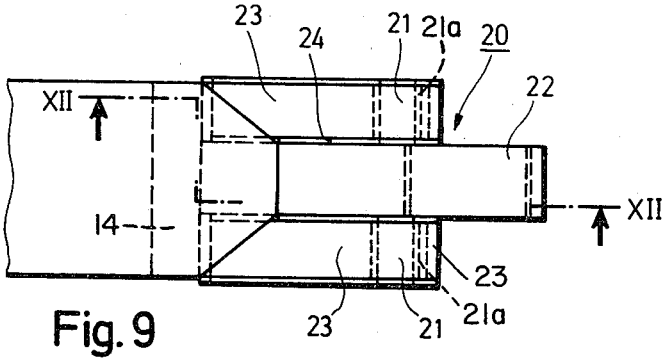
Figure 10:
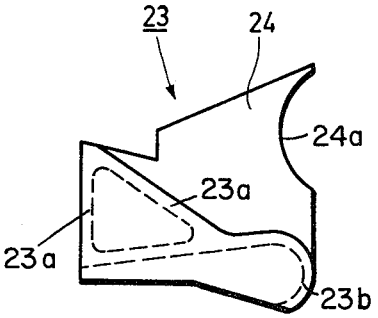
FIG. 10 shows a top plan view of a bridging web for use in the embodiment of FIGS. 8 and 9.
Figure 11:
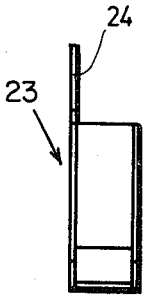
FIG. 11 is a side view of the bridging web member of FIG. 10.
Figure 12:
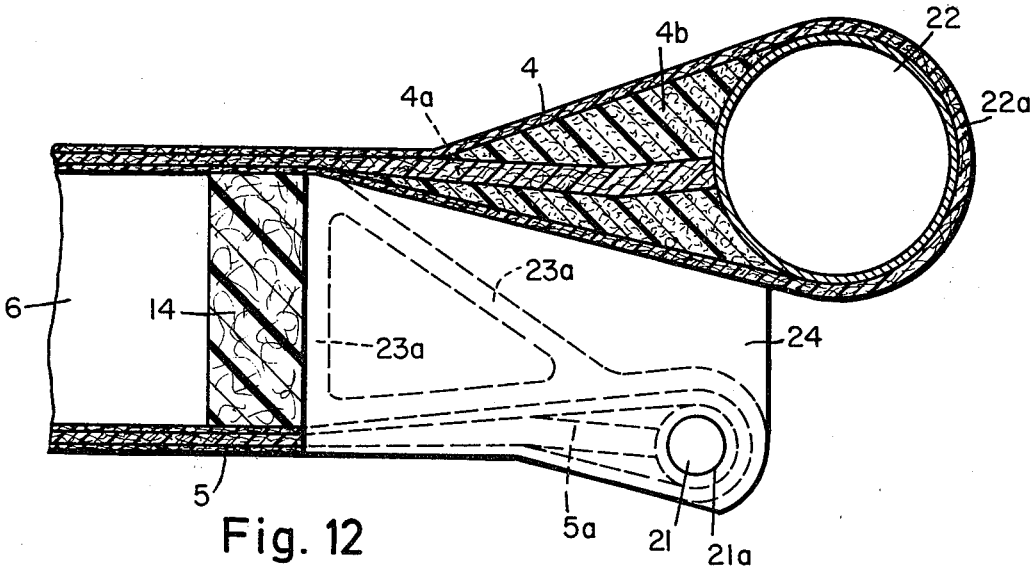
FIG. 12 is a sectional view through the connecting element illustrated in FIGS. 8 and 9, whereby the sectional plane extends along section line XII—XII in FIG. 9.

FIGS. 8 to 12 illustrate a further embodiment showing a connecting element 20 having two coaxially aligned bolt eyes 21 formed, for example, by respective metal bushings 21*a*. The coaxially aligned bolt eyes 21 are arranged above and below a third intermediate bolt eye 22 formed by a metal bushing 22*a*. Two bridging members 23 of mirror-symmetrical shape relative to each other are arranged to brace the bolt eyes 21, 22 relative to each other. One of the bridging members 23 is shown in FIGS. 10 and 11. Each of the two bridging members 23 is provided with a looping portion 23*b* and reinforcing ribs 23*a*. The looping portion 23*b* reaches in an approximately semi-circular fashion around the respective bushing 21*a*. An extension 24 of each bridging member 23 forms simultaneously a cover on one side of the respective bridging member. The extension 24 is provided with a curved recess 24*a* as shown in FIG. 10 in which the respective bolt eye forming bushing 22*a* is received. As best seen in FIGS. 8 and 12, each of the bridging members 23 reaches with its looping member 23*b* around the respective bushing 21*a*, whereby the bracing is accomplished in that the cover or extension 24 supports the bushing 22*a*. The sectional view of FIG. 12 shows substantially a similar structure as that shown in FIG. 7 and the connection of the bolt eyes with their bridging members to the girder 6 is the same as that described above with reference to FIG. 7.

The described embodiments are examples only since differently shaped connecting elements having at least two bolt eyes may be provided with reinforcing bridging members as taught by the invention, whereby at least one of the bolt eyes is received in an approximately semi-circular looping member and the other bolt eye is braced by the bridging member to thereby achieve the desired stiffening. It is also within the teaching of the invention to use materials other than fiber reinforced synthetic materials. However, in order to provide structures which have a very advantageous weight to strength ratio, fiber reinforced materials are preferred. Highest strength values have been achieved by using carbon fibers.

Although the invention has been described with reference to specific example embodiments, it is to be appreciated that it is intended to cover all modifications and equivalents within the scope of the appended claims.

What is claimed is:

1. A load transmitting connecting element, comprising at least two bolt eyes for receiving respective bolts to connect such an element to another structural component also provided with bolt eyes, each bolt eye having a respective central axis, bridging web means operatively interposed between said two bolt eyes, said bridging web means having a main plane extending substantially at a right angle to said central bolt eye axes for bracing the bolt eyes relative to each other, said bridging web means having looping means looping around at least one of said bolt eyes approximately in a semicircular manner.

2. The connecting element of claim 1, comprising first, second and third bolt eyes (21, 22) of which the first and second bolt eyes are located to have a common axis, said third bolt eye (22) being located between the first and second bolt eye (21) and so that the axis of the third bolt eye extends in parallel to said common axis, said bridging web means comprising first and second bridging web members (23) extending substantially in parallel to each other and looping in a substantially semicircular manner around the respective first and second bolt eye, said bridging web means further comprising web extension means (24) operatively connected to said first and second bridging web members and bearing against said third bolt eye (22), whereby all three bolt eyes are braced relative to each other.

3. The connecting element of claim 1, comprising a first pair of bolt eyes (2) and a second pair of bolt eyes (3) arranged so that the bolt eyes of the first pair have a common first axis and so that the bolt eyes of the second pair also have a common second axis, said first and second axes extending in parallel to each other, said bridging web means further comprising first and second bridging web members each looping in a semicircular manner around an bolt eyes in one pair and around an bolt eyes in the other pair so that the first and second bridging web members extend in parallel to each other whereby the first and second pairs of bolt eyes are braced relative to each other.

4. The connecting element of claim 1 or 2 or 3, wherein said bolt eyes comprise metal bushings, said element further comprising chord means surrounding said metal bushings, said chord means extending at an acute angle toward said structural component and being connected to said structural component.

5. The connecting element of claim 4, wherein said chord means are made of fiber reinforced synthetic material including long fibers extending around said metal bushings thereby forming wedge shaped spaces (4*b*, 5*b*), said element further comprising wedge shaped filler members of short fibers impregnated with synthetic resin and fitting into said wedge shaped spaces.

6. The connecting element of claim 1, or 2, or 3, further comprising chord means surrounding said bolt eyes, said bridging web means being made of fiber reinforced synthetic material, said chord means merging into said bridging web means whereby the bridging web means interconnect and brace the chord means.

7. The connecting element of claim 6, wherein said bridging web means comprise half loops (10*b*, 23*b*) forming said looping means, said bridging web means further comprising bracing strut means (10*a*, 23*a*), both, said half loops and said bracing strut means being made of long, synthetic resin impregnated fibers.

8. The connecting element of claim 1, wherein said bridging web means comprise cover members (13) which cover the respective bridging web means partially or completely or which extend laterally outside of the respective bridging web means.

9. The connecting element of claim 8, wherein said cover members are made to comprise cross-wise wound windings of synthetic resin reinforced fibers.

10. The connecting element of claim 8, wherein said cover members are made of a fabric of fiber reinforced synthetic material.

11. The connecting element of claim 9 or 10, wherein said bridging web means are connected to said bolt eyes and to said cover members by a suitable adhesive.

12. The connecting element of claim 4, wherein said bridging web means are connected to said chord means by a suitable adhesive.

* * * * *